US006565389B1

(12) United States Patent
Igarashi

(10) Patent No.: US 6,565,389 B1
(45) Date of Patent: May 20, 2003

(54) CONNECTOR OF A THIN TYPE

(75) Inventor: Isao Igarashi, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/710,586

(22) Filed: Nov. 9, 2000

(30) Foreign Application Priority Data

Nov. 12, 1999 (JP) ..... 11-322219

(51) Int. Cl.[7] ..... H01R 17/00
(52) U.S. Cl. ..... 439/660
(58) Field of Search ..... 439/260, 495, 439/607, 660

(56) References Cited

U.S. PATENT DOCUMENTS 5,401,186 A * 3/1995 Nozaki et al. ..... 439/495
5,688,143 A * 11/1997 McHugh et al. ..... 439/495
6,066,000 A * 5/2000 Masumoto et al. ..... 439/607
6,077,118 A * 6/2000 Harada et al. ..... 439/607
6,120,323 A * 9/2000 Zhung et al. ..... 439/567
6,231,378 B1 * 5/2001 Wu et al. ..... 439/495
6,299,481 B1 * 10/2001 Doi ..... 439/607

* cited by examiner

*Primary Examiner*—Lynn Field
*Assistant Examiner*—Thanh-Tam Le
(74) *Attorney, Agent, or Firm*—Michael Best & Friedrich LLC

(57) ABSTRACT

It is possible to adopt a structure for a plug connector coupling section having only one layer of contacts, by a structure where one side wall of a coupling section for coupling with a plug connector forms an insulator flange section 2*b*, while the other side wall thereof forms a first shell 4, contacts 3 being positioned in contact receiving grooves 2*d* provided in the flange section. The plug connector coupling section may have a three-layer structure only, comprising contacts, an insulator and a shell. Alternatively, it may have a two-layer structure comprising contacts and an insulator. The thickness of the receptacle connector 1 is thereby reduced in comparison with respective prior art connectors.

8 Claims, 11 Drawing Sheets

CONNECTOR OF A THIN TYPE

BACKGROUND OF THE INVENTION

The present invention relates to a connector having a shell (ground plate) for preventing EMI (electromagnetic interference) and, more particularly, to achieving a thin type of connector.

Firstly, a prior art connector as disclosed in Japanese Patent Laid-open No. (Hei) 10-270125 is described with reference to FIG. 1. The connector is constituted by a receptacle connector 51 and a plug connector 61. The receptacle connector 51 comprises a housing 52, a plurality of pine contacts 53 supported by the housing 52, and a shield cover 54 covering the housing 52. The plug connector 61 comprises a housing 62, a plurality of socket contacts 63 supported by the housing 62, and a shield cover 64 covering the housing 62. A projecting strip 63A of the shield cover 64 of the plug connector 61 makes contact with the inner face of the shield cover 54 of the receptacle connector 51. The lower portion of the shield cover 54 of the receptacle connector 51 is formed as a conductor pattern on a printed circuit board 66.

In the case of this prior art example, the plug connector 61 comprises two symmetrical three-layer structures comprising a shell, an insulator side wall and contacts, whilst the plug-side connector 51 has a structure where the respective three-layer structures are received on both sides of the contacts 53 thereof, respectively. Therefore, the thickness of the receptacle connector 51 is inevitably large. The height of the receptacle connector 51 above the printed circuit board 66 is taken as H1.

Next, another prior art receptacle connector as disclosed in Japanese Patent Laid-open No. (Hei) 11-185883 is described with reference to FIG. 2. The receptacle connector 71 forming an I/O connector comprises a housing 72, a plurality of contacts 73 supported by a central projecting section of the housing 72, and a shield cover 74 covering the housing 72. This receptacle connector 71 can be connected to the plug connector illustrated in FIG. 1. Accordingly, the height H2 of the receptacle connector 71 above the printed circuit board is approximately the same as the height H1 in FIG. 1.

Next, a prior art connector for an FPC (flexible printed circuit board) is described with reference to FIG. 3 to FIG. 5. The receptacle connector 81 is constituted by an insulator 82, a plurality of contacts 83 press-fitted in an aligned fashion into the insulator 82, ground contacts 86 confronting same, a first shell 84 press-fitted onto the lower portion of the insulator 82, and a second shell 85 press-fitted onto the upper face of the insulator 82.

The plug connector 91 connected to the FPC comprises an insulator 92, a plurality of contacts 93 press-fitted into the insulator 92, a ground plate 94 attached to the lower portion of the insulator 92, a shell 95 press-fitted onto the upper face of the insulator 92, and a slider 96 disposed slidably between FPC contact sections 93*a* of the contacts 93 and the ground plate 94. The insulator 92 comprises upper and lower side walls 92*a* and 92*b* forming an FPC inserting section, and a plate-shaped section 92*c* forming a coupling section for coupling with the receptacle connector. Each of the contacts 93 comprises an FPC contact section 93*a* projecting into the FPC inserting section, and a contact section 93*b* disposed above the aforementioned plate-shaped section 92*c* for connecting with a contact of the receptacle connector. The ground plate 94 is molded to the insulator 92 in such a manner that it extends from the upper face of the lower-side wall 92*b* of the insulator 92 to the lower face of the plate-shaped section 92*c*.

In a state where the slider 96 is pulled out from the FPC inserting section, an FPC is inserted between the FPC contact sections 93*a* of the contacts and the ground plate 94, whereupon, by pressing the slider 96 back into position, the FPC is connected to the contacts 93, whilst also being prevented from being removed readily.

In this FPC connector 91, the coupling section inevitably has a large thickness, since it comprises three layers formed in the vertical direction, namely, the contact sections 93*b* of the contacts, the plate-shaped section 92*c* of the insulator, and the ground plate 94. Consequently, the receptacle connector 81 coupling with same naturally has a large thickness.

SUMMARY OF THE INVENTION

In a prior art plug connector, since the coupling section comprises a two-stage, upper and lower, three-layer structure comprising contacts, an insulator and a shell (ground plate), then a receptacle connector connecting to same inevitably has a large thickness.

Moreover, although the coupling section of the plug connector comprises a three-layer structure of a ground plate, contacts and an insulator, the coupling section of the receptacle connector receiving same must comprise an insulator, contacts, ground contact, and shell, and hence has a larger thickness.

Therefore, it is one object of the present invention to devise a structure whereby the thickness of the section of the aforementioned receptacle connector which couples with a plug connector can be reduced. It is a further object of the present invention to provide a plug connector wherein the thickness of the coupling section which couples with the aforementioned receptacle connector is reduced.

According to the present invention, a connector of a thin type having a composition as described in any one of paragraphs 1 to 12 below is obtained.

1. A receptacle connector of a thin type characterized in that said receptacle connector comprises an insulator formed in a frame shape, and a plurality of contacts fixed to said insulator, and that one of the pair of opposing side walls of the connector constituting a section for coupling with a plug connector is formed by a first shell made from metal while the other side wall is integrally molded with said insulator.
2. The receptacle connector of a thin type according to 1 above, characterized in that a plurality of bend sections formed on one side edge of said first shell are molded in said insulator.
3. The receptacle connector of a thin type according to 2 above, characterized in that a second shell made from metal is layered over the outer surface of said other side wall, and connection is made between connecting sections of said first shell and connecting sections of said second shell.
4. The receptacle connector of a thin type according to 3 above, characterized in that each of said plurality of contacts comprises a section for attaching to the insulator, a cantilever shaft section extending forwards from said attaching section, a contact section at the front end thereof, and a terminal section extending rearwards from said cantilever shaft section, a plurality of contact receiving grooves being formed in parallel fashion in the inner face of said side wall of said insulator, whereby the respective cantilever shaft sections of said contacts fit into respective contact receiving grooves with a play, said contact sections projecting towards said first shell from said contact receiving grooves.

5. The receptacle connector of a thin type according to 4 above, characterized in that the side wall of said insulator forms the base portion of said contact receiving grooves and comprises through holes of smaller dimension than the contact sections of said contacts, provided in the portion thereof opposing the contact sections of said contacts.

6. The receptacle connector of a thin type according to 4 above, characterized in that the side wall of said insulator forms the base portion of said contact receiving grooves, slits of smaller width than that of the contact sections of said contacts being formed at least in the portion thereof opposing the contact sections of said contacts.

7. The receptacle connector of a thin type according to 2 above, characterized in that said plurality of contacts and said plurality of bend sections in said first shell are disposed in a zigzag fashion in said insulator.

8. The receptacle connector of a thin type according to 4 above, characterized in that insulating tape or an insulating coating is provided on the surface of said first shell opposing said contacts.

9. A plug connector of a thin type having a plug-side coupling section which is introduced into the coupling section of the receptacle connector according to 4 above, characterized in that said plug-side coupling section comprises a plug-side insulator plate member, and plug-side contacts having plug-side contact sections embedded in one surface of said plate member with the surface thereof being exposed, in such a manner that they form contact with the contact sections of said receptacle-side contacts.

10. The plug connector of a thin type according to 9 above, characterized in that said plug connector is a connector for connecting an FPC (flexible printed circuit), comprising a plug-side insulator, the rearward portion of which is formed in a frame shape and the front portion of which incorporates said plate-shaped section, and a plurality of said plug-side contacts fixed to said plug-side insulator, and that one of the pair of opposing side walls forming the FPC inserting section for connecting to said FPC is formed by a first plug-side shell made from metal while the other side wall is integrally molded with said plug-side insulator, the contact sections of said plug-side contacts for connecting with the FPC being exposed inside said FPC inserting section.

11. The plug connector of a thin type according to 10 above, characterized in that said first plug-side shell comprises a plurality of shell terminal sections formed on the front edge thereof, said shell terminal sections being embedded in the rear face of said plate-shaped section of said plug-side insulator and being disposed in a zigzag fashion with the plug-side contact sections of said plug-side contacts in said plate-shaped section.

12. The plug connector of a thin type according to 11 above, characterized in that a second plug-side shell made from metal is layered over the outer surface of the side wall constituted by said plug-side insulator of said FPC inserting section, and a slider is engaged with and retained by said first plug-side shell in such a manner that it may slide in and out of said FPC inserting section, over said first plug-side shell.

BEST MODE FOR CARRYING OUT THE INVENTION

Figure 1:
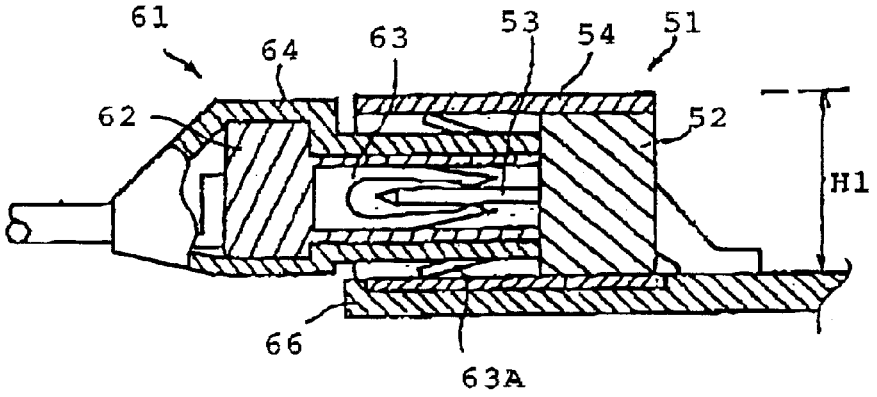
FIG.1 PRIOR ART
FIG. 1 is a sectional view illustrating a prior art plug connector and receptacle connector in an coupled state.
Figure 2:
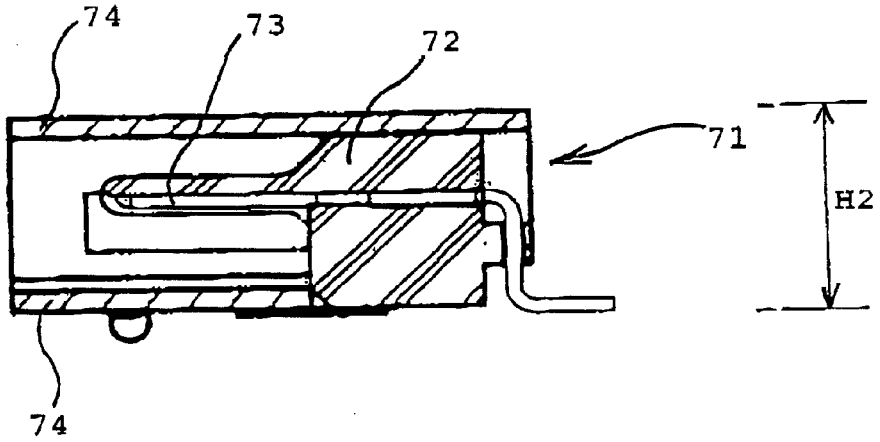
FIG.2 PRIOR ART
FIG. 2 is a sectional view of a further receptacle connector according to the prior art.
Figure 3:
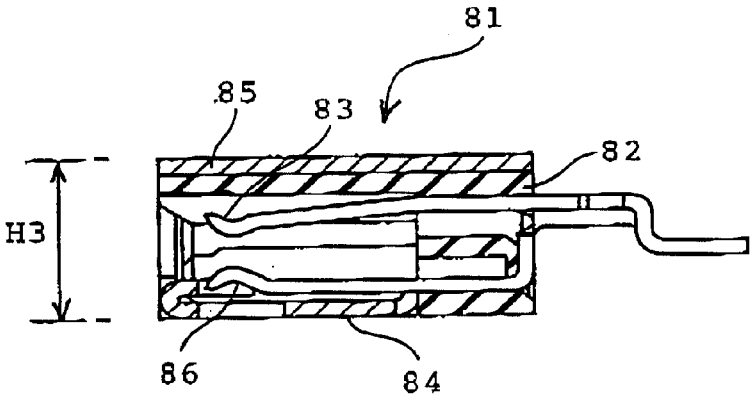
FIG.3 PRIOR ART
FIG. 3 is a sectional view of a receptacle connector coupled with a prior art FPC connector.
Figure 4:
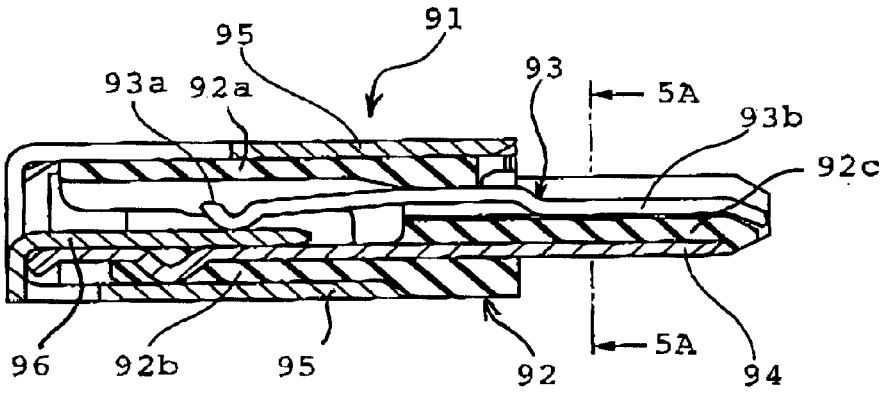
FIG.4 PRIOR ART
FIG. 4 is a sectional view of a prior art FPC connector.
Figure 5:
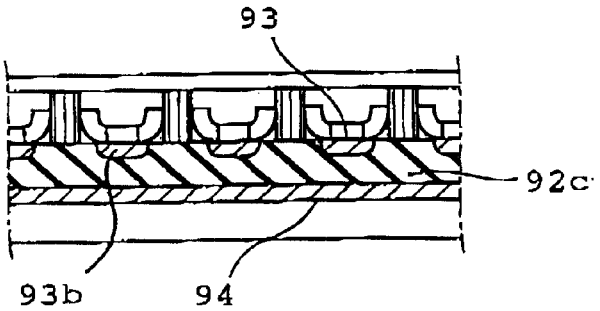
FIG.5 PRIOR ART
FIG. 5 is a sectional view along line 5A—5A in FIG. 4.

Examples of connectors of a thin type according to embodiments of the present invention are described below.

Firstly, a first embodiment of the present invention is described with reference to FIG. 6 and FIG. 7.

A receptacle connector 1 comprises an insulator 2, a plurality of contacts 3 press-fitted in aligned fashion in the insulator 2, a first shell 4 press-fitted onto the lower section of the insulator 2, and a second shell 5 press-fitted onto the upper face of the insulator 2.

Figure 6:
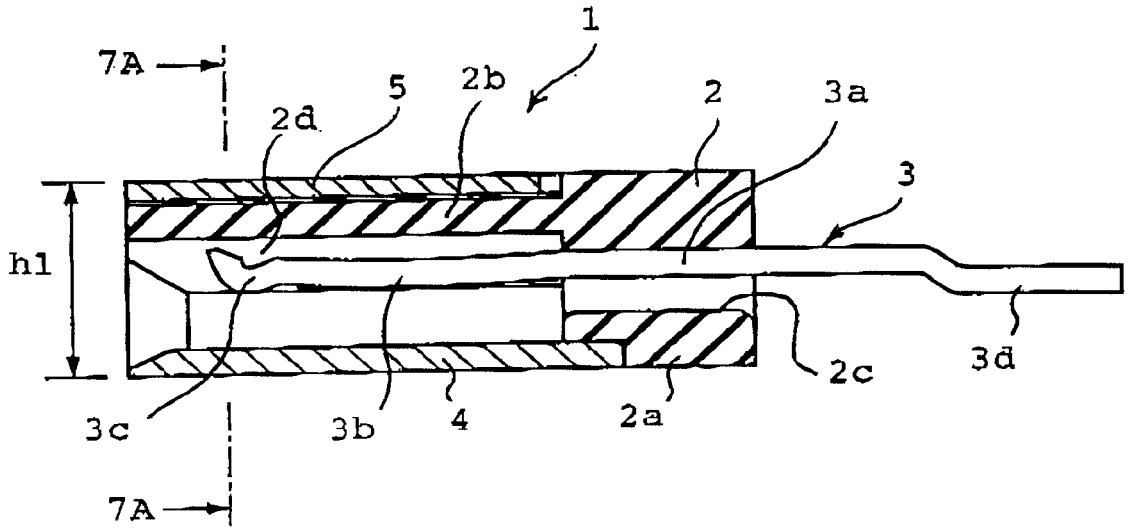
FIG. 6 is a sectional view of a receptacle connector of a thin type according to a first embodiment of the present invention.

The insulator 2 has a long and thin prismatic section 2*a* extending in a perpendicular direction to the plane of the paper in FIG. 6, and a flange section 2*b* extending in a forward direction (leftward direction in FIG. 6) from the vicinity of the upper edge of the prismatic section 2*a*, the aforementioned prismatic section 2*a* having a plurality of contact retaining holes 2*c* juxtaposed in the longitudinal direction thereof, and a plurality of contact receiving grooves 2d being formed in the lower face of the flange section 2*b*. The contacts 3 each comprise a contact retaining section 3*a* press-fitted into a contact retaining hole 2*c*, a cantilever shaft section 3*b* extending forwards in a contact receiving groove 2*d*, a U-shaped contact section 3*c* provided on the front end thereof, and a contact terminal section 3*d* extending externally in a rearward direction (rightward direction in FIG. 6) from the contact retaining section 3*a*.

Figure 7:
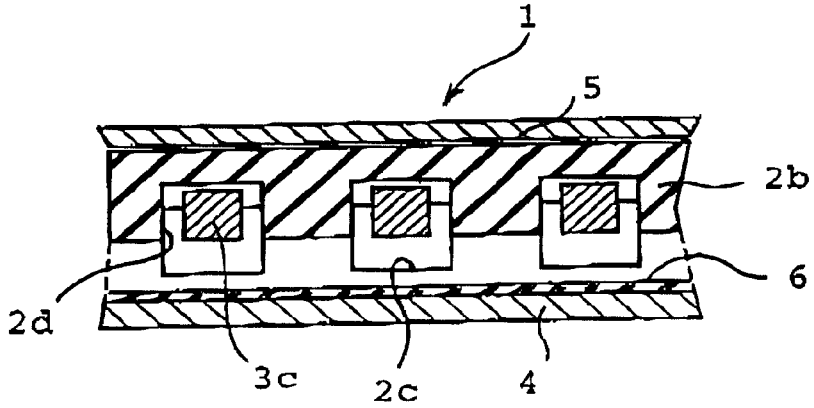
FIG. 7 is a sectional view along line 7A—7A in FIG. 6.

In FIG. 6 and FIG. 7, it is supposed that a plug connector is connected to this receptacle connector, the cantilever shaft sections 3*b* of the contacts 3 being formed elastically, and a state being illustrated where the contact sections 3*c* have been pressed into the contact receiving grooves 2*d*.

When the receptacle connector 1 is not coupled with a plug connector, the U-shaped contact sections 3*c* at the front end of each contact 3 are disposed projecting downwards from the contact receiving holes 2*d*. In other words, the contact sections 3*c* are positioned slightly below the state illustrated in FIG. 6.

The receptacle connector has a coupling section with the plug which section comprises a flange section 2*b* and a first shell 4 opposing same. The contacts 3 are disposed inside this coupling section.

In the receptacle connector 1, one side wall of the plug connector coupling section is taken as the flange section 2*b* of the insulator 2, whilst the other side wall thereof is taken as the first shell, and the contacts are positioned in the contact receiving grooves provided in the flange section, so that it is possible to achieve a structure for the plug connector coupling section comprising one layer of contacts only. Consequently, the plug connector coupling section may have only a three-layer structure comprising contacts, an insulator and a shell, or it may have a two-layer structure comprising contacts and an insulator. Therefore, taking the height of the receptacle connector 1 as h1, it is clear that this height can be made smaller than any of the heights H1, H2, and H3 of the prior art connectors (see FIG. 1 to FIG. 4).

For practical use, the contacts 3 and the first shell 4 should either be provided with a thin insulating coating, or a thin insulating tape, on the opposite side of the first shell 4 to the contacts 3, as illustrated by 6 in FIG. 7, in order to prevent the risk of incorrect connection between the contact 3 and the first shell 4 when the plug connector is not inserted.

Figure 8:
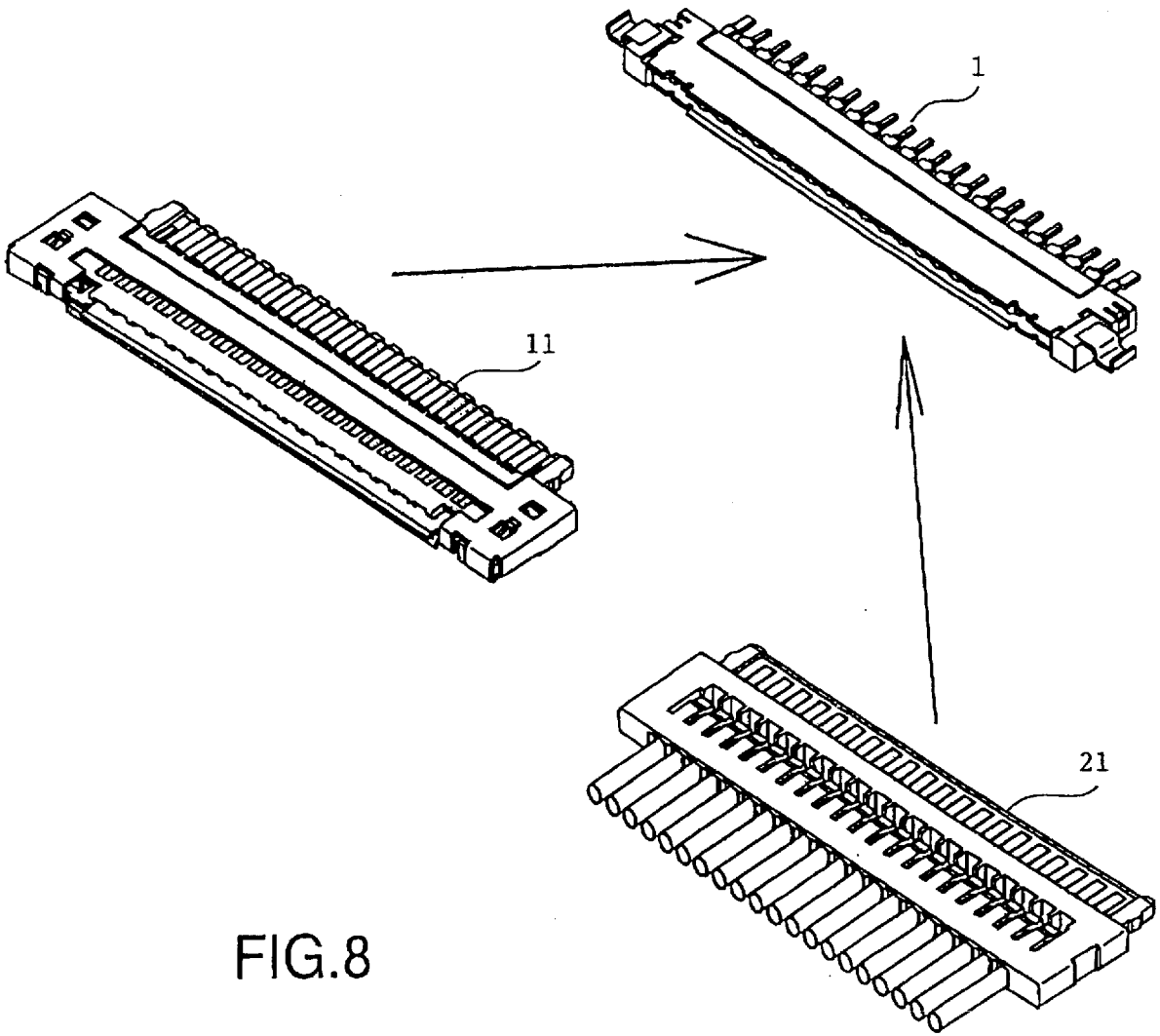
FIG. 8 is a perspective view showing the receptacle connector of a thin type according to the first embodiment of the present invention, and an FPC-type and wire-type plug connector, respectively, before coupling.

As shown by a general view in FIG. 8, this receptacle connector 1 can be coupled and connected with an FPC connector 11 or cable connector 21.

Figure 9A:
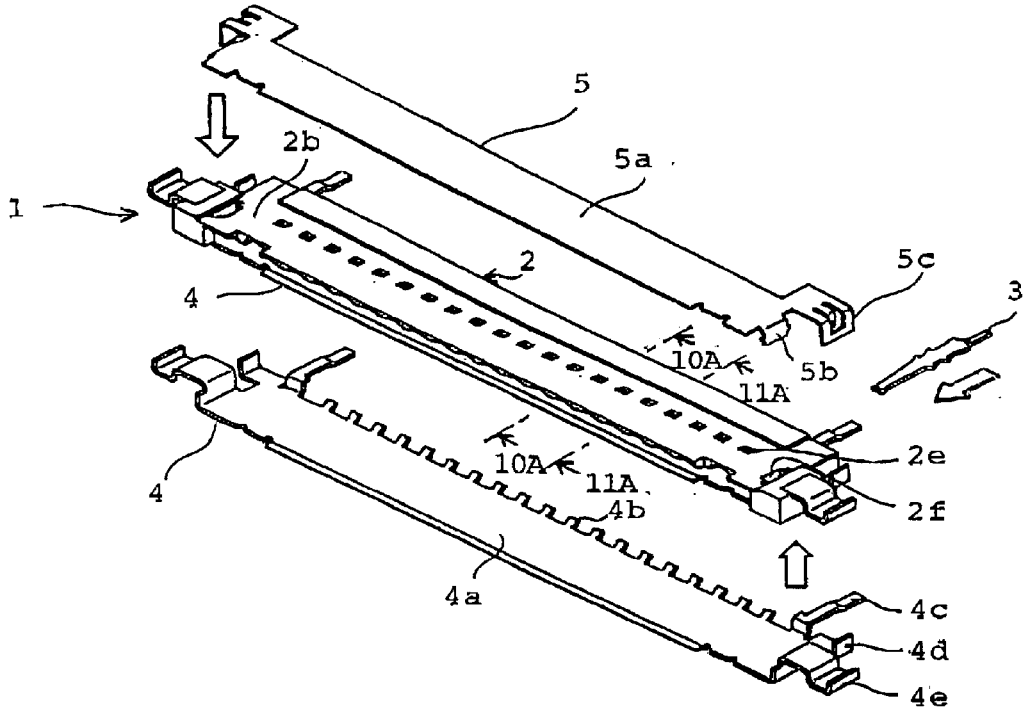
FIG. 9A is a perspective view showing an intermediate assembly state of a receptacle connector of a thin type according to a second embodiment of the present invention and FIG. 9B is a perspective view showing same in a completely assembled state.
Figure 9B:
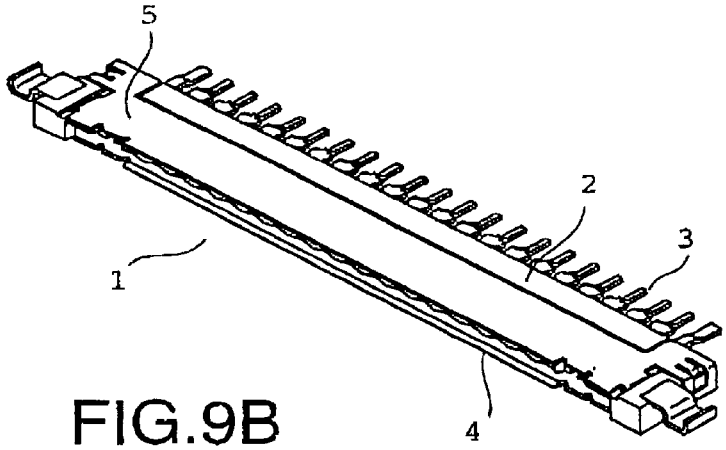

Next, a second embodiment of the present invention is described with reference to FIG. 4 to FIG. 11. FIG. 9A is an expanded perspective view of a connector, and FIG. 9B illustrated a connector in a completely assembled state.

Here, the receptacle connector 1 has approximately the same composition as the connector in FIG. 6. In other words, it comprises an insulator 2, a plurality of contacts 3 press-fitted in an aligned fashion into the insulator 2, a first shell 4 made from metal attached to the lower portion of the insulator 2, and a second shell 5 made from metal press-fitted onto the upper face of the insulator 2. The insulator 2 is formed in a frame shape, having a flange section 2*b* as an upper side wall on the upper side thereof, whilst the lower side wall on the lower side thereof is constituted by the first shell 4.

In this embodiment, in the portion of the flange section 2*b* opposing the contact sections 3*c* and being the bottom section of the contact receiving grooves 2*d*, are formed holes, namely, through holes 2*e*, of smaller dimension than the contact sections 3*c*. Provision of these holes 2*e* enables to avoid difficulties arising in resin molding when the thickness of the under face of the contact receiving grooves 2*d* is reduced in order to decrease the thickness of the flange sections 2*b* of the insulator. Consequently, it is possible to achieve thinner molding than in the case of the embodiment illustrated in FIG. 6.

Furthermore, the first shell 4 comprises an approximately rectangular plate section 4*a* as the aforementioned one side wall, a plurality of bend sections 4*b* formed in the rear side edge (right-hand edge in FIG. 9A) of the plate section 4*a*, a pair of ground terminal sections 4*c* formed projecting on either side of the bend sections 4*b*, a pair of connecting sections 4*d* formed bending to the outer side of the respective ground terminal sections 4*c*, and a pair of hold down sections 4*e* formed projecting to either side of the plate 4*a*. FIG. 9A illustrates a state where the first shell 4 is attached to the lower face of the insulator 2, but in order to clarify the composition of the first shell 4, the first shell 4 is depicted independently on this side. The first shell 4 is attached by molding to the insulator 2, and the angled sections 4*b* are embedded in the lower section of the prismatic section 2*a* of the insulator 2. Thereby, the fixing of the first shell 4 and insulator 2 is strengthened, and hence the first shell is prevented from detaching from the insulator 2 when the receptacle connector is coupled with a plug connector.

The second shell 5 comprises an approximately rectangular plate section 5*a*, a pair of engaging sections 5*b* formed by bending at either end face of the plate section 5*a*, and a pair of connecting sections 5*c* formed by bending in adjacent positions to the respective coupling sections 5*b*. When the second shell 5 is press-fitted onto the insulator 2 and the first shell 4, the pair of engaging sections 5*b* engage with a pair of engaging holes 2*f* in the insulator 2, and furthermore, the pair of connecting sections 5*c* connect with the pair of connecting section 4*d* in the first shell 4, thereby completing assembly of the receptacle connector 1 and obtaining the state illustrated in FIG. 9B.

Figure 10:
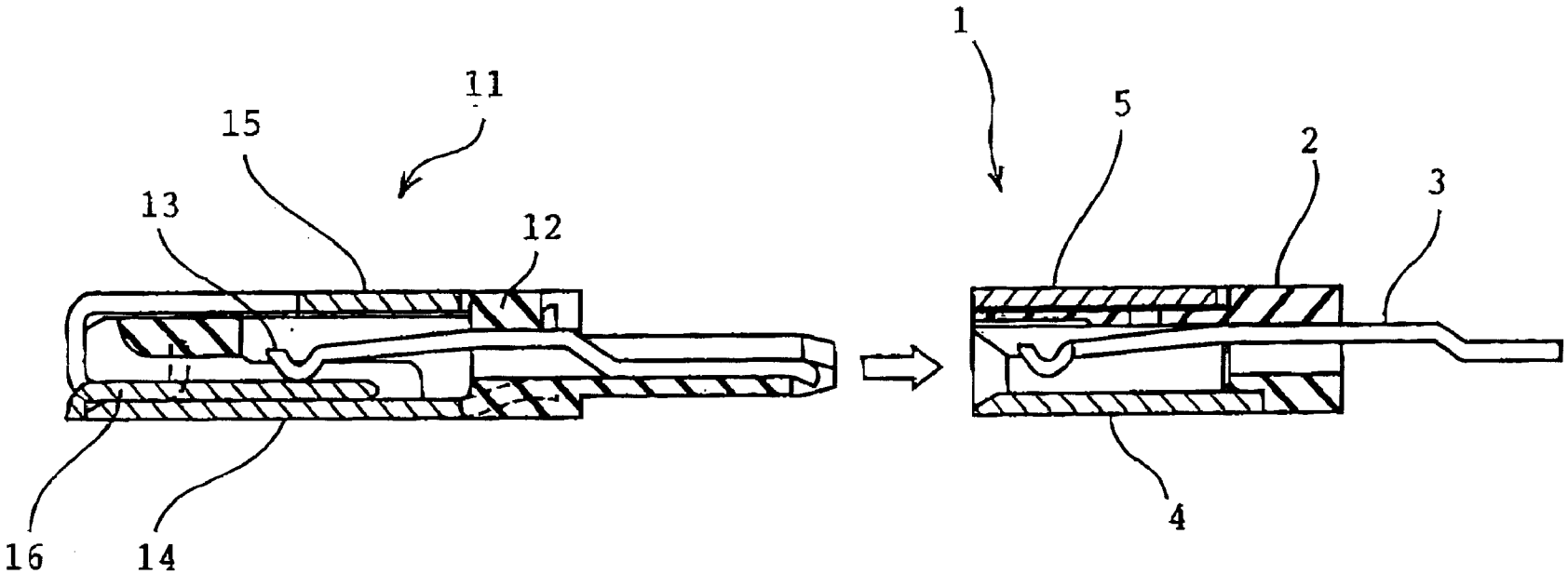
FIG. 10 is a sectional view showing a section of a receptacle connector of a thin type according to a second embodiment of the present invention along line 10A—10A in FIG. 9A, in a state prior to coupling with an FPC connector.

In FIG. 10, the cross-section along line 10A—10A of the receptacle connector in FIG. 9A illustrates an FPC connector 11 such as that shown in FIG. 8 as a plug connector connected to the receptacle connector 1. The FPC connector 11 comprises an insulator 12, a plurality of contacts 13 press-fitted in the insulator 12 for contacting with an FPC (not illustrated), a first shell 14 also forming a ground plate attached by molding to the lower section of the insulator 12, a second shell 15 press-fitted onto the upper face of the insulator 12, and a slider 16 held slidably in the coupling direction. This FPC connector is described in more detail below with reference to FIGS. 9 to 11.

When the FPC connector 11 is coupled with the receptacle connector 1 in the direction of the arrow, the respective connectors 11 and 1 become connected.

Figure 11:
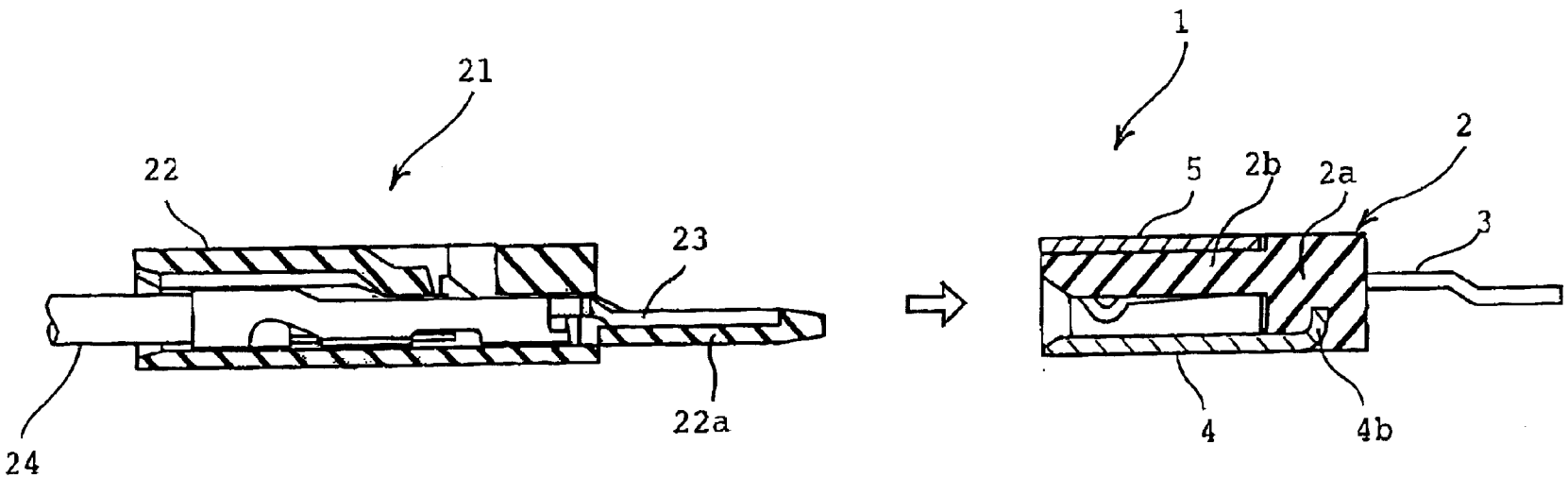
FIG. 11 is a sectional view showing a section of a receptacle connector of a thin type according to a second embodiment of the present invention along line 11A—11A in FIG. 9A, in a state prior to coupling with a wire-type plug connector.
Figure 12A:
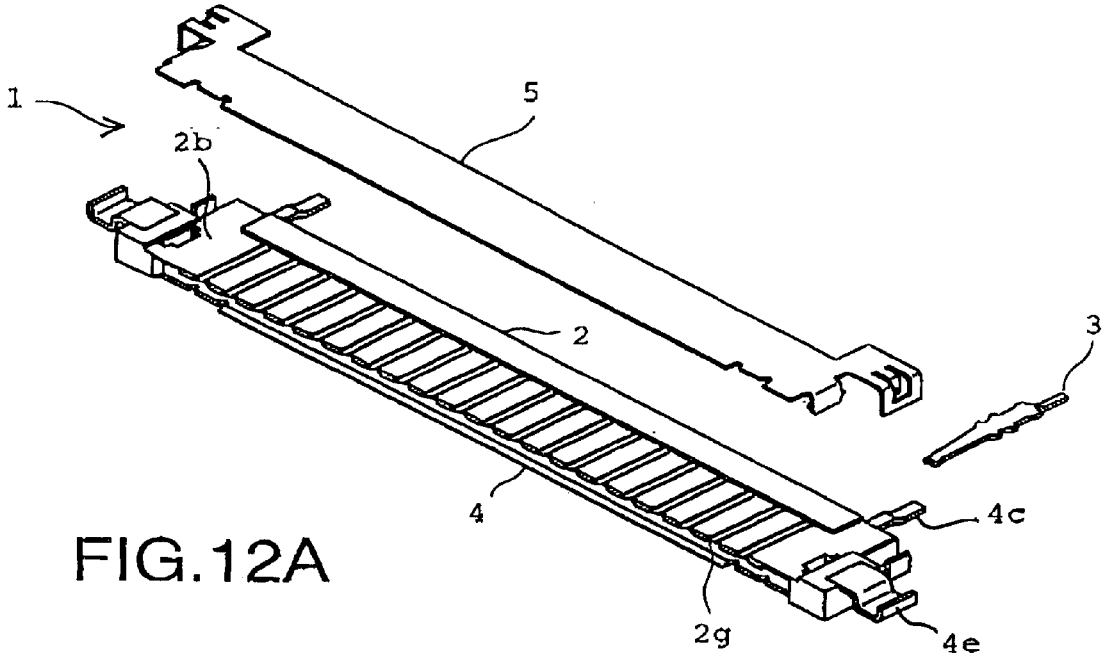
FIG. 12A is a perspective view showing a receptacle connector of a thin type according to a third embodiment of the present invention in an intermediate state of assembly and FIG. 12B is a perspective view showing same in a completed assembly state.
Figure 12B:
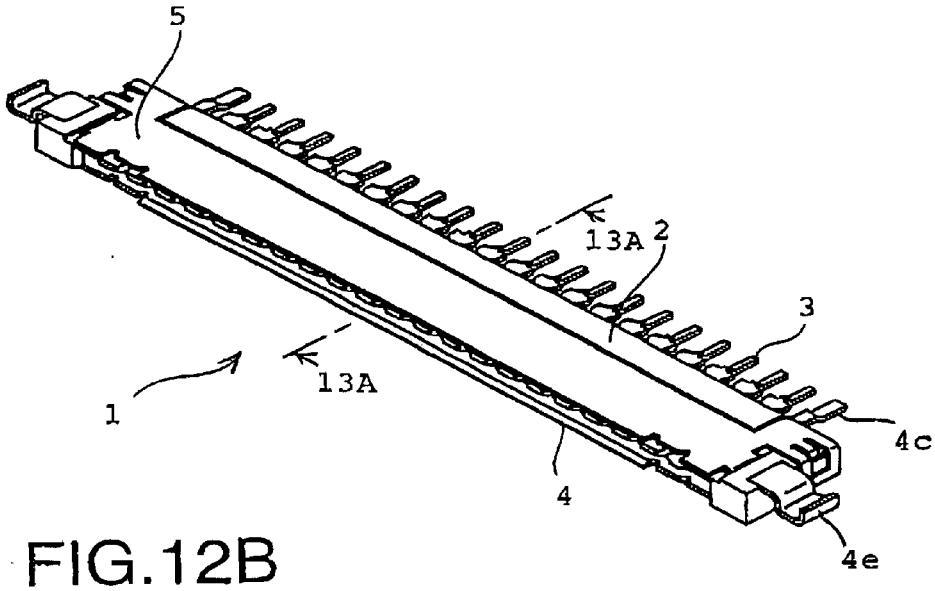

In FIG. 11, the sectional view along line 11A—11A of the receptacle connector in FIG. 9A shows a cable connector 21 such as that in FIG. 8 as a plug connector connected to the receptacle connector. This cable connector 21 comprises a housing 22 and a plurality of contacts 23 respectively connected and fixed to a plurality of cables 24. In the cable connector 21, the coupling section with the receptacle connector 1 can be formed very thinly, since the contacts 23 are introduced into a projecting section 22*a* of the insulator of the housing 22 with their surfaces in an exposed state.

When the cable connector 21 is coupled with the receptacle connector 1 in the direction of the arrow, the respective connectors 21 and 1 become connected.

As illustrated by FIG. 10 and FIG. 11, in the receptacle connector 1, the angled sections 4*b* of the first shell 4 and the contacts 3 are disposed in alternating fashion. In other words, since they are disposed in a zigzag fashion within the insulator, even if the bend sections 4*b* are molded into the insulator 2, it is not necessary to increase the thickness of the prismatic section 2*a* of the insulator 2 in order to prevent contact with the contacts 3.

Next, a third embodiment of the present invention is described with reference to FIG. 7 and FIG. 8. As illustrated in FIG. 7, the third embodiment differs from the second embodiment in that a plurality of slits 2*g* are provided in the flange section 2*b* in the upper face of the insulator 2, instead of a plurality of through holes 2*e*, apart from which point, the composition thereof is the same, and hence further description is omitted and in the drawings, the same reference numbers are used for similar sections.

FIG. 8 illustrates a state where the respective contacts 3 of the receptacle connector 1 connect with the contacts (not illustrated) of a plug connector, the front ends of the respective contacts 3 being displaced and inserted into respective slits 2*g*. When the receptacle connector 1 is not coupled with the plug connector, the U-shaped contact sections 3*c* at the front ends of the each contact 3 project downwards from the contact receiving grooves 2*d*, assuming positions slightly below the state illustrated in FIG. 13A. The height h2 of the receptacle connector 1 is smaller than the respective heights H1, H2, H3 of the prior art connectors (see FIG. 1 to FIG. 4) and is also smaller than the height h1 of the connector illustrated in FIG. 6.

Figure 13A:
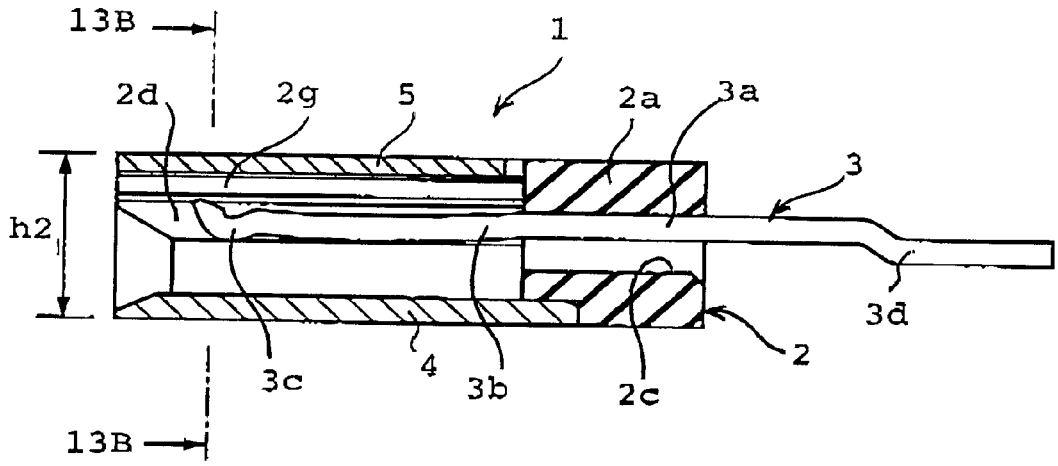
FIG. 13A is a sectional view of a receptacle connector of a thin type according to a third embodiment of the present invention along line 13A—13A in FIG. 12B.

The width of the respective slits 2*g* is set to be narrower than the width of the contact sections 3*c* of the respective contacts 3. Therefore, when coupling with a plug, even if the contact sections 3*c* of the respective contacts 3 are displaced as illustrated in FIG. 13A, they do not make contact with the second shell 5. The reason for providing the respective slits 2*g* is the same as that for providing the holes 2*e* in the fourth embodiment.

Moreover, as a fourth embodiment of the present invention, the FPC connector 11 shown in FIG. 8 and FIG. 10 is now described with reference to FIG. 9–FIG. 15B.

Figure 14A:
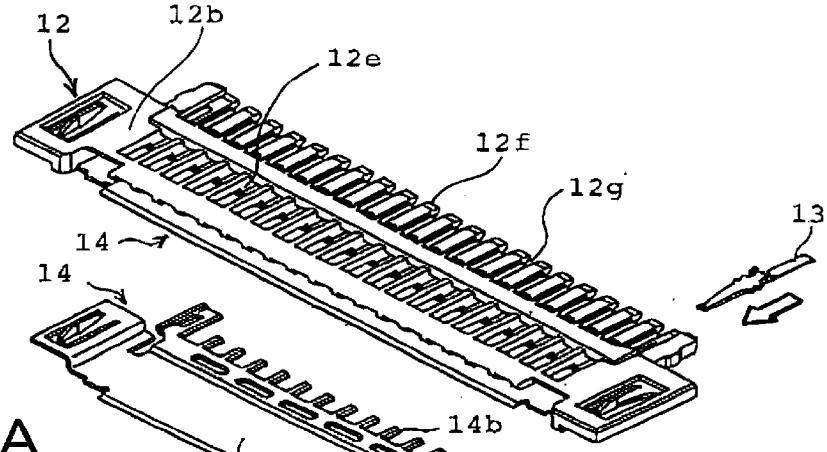
FIG. 14A is a perspective view showing an insulator molded with a first shell, and a first shell and contacts, according to an FPC connector in a fourth embodiment of the present invention.
Figure 14B:
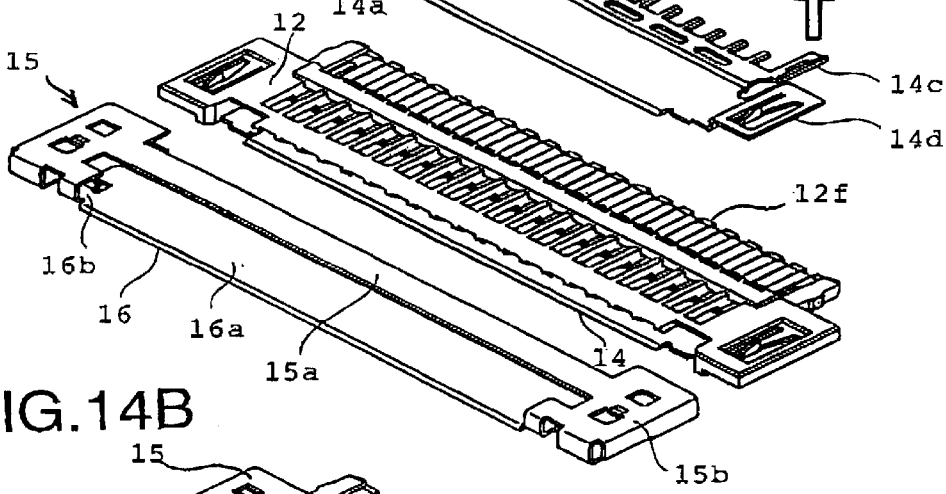
FIG. 14B is a perspective view showing an insulator molded with a first shell, a second shell and a slider.
Figure 14C:
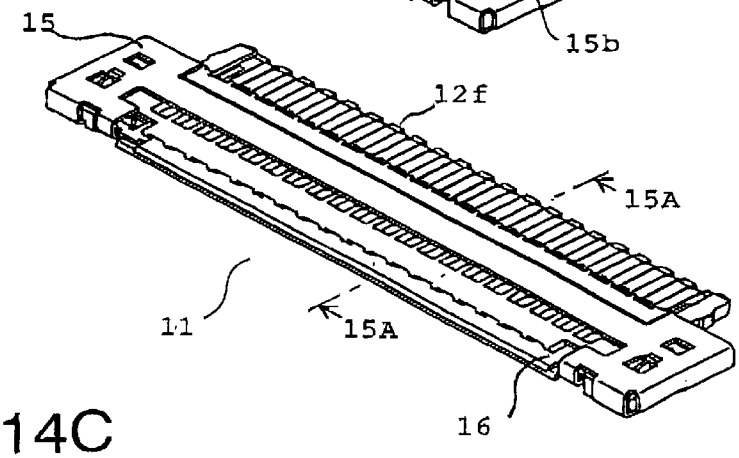
FIG. 14C is a perspective view showing same in a completed state of assembly.
Figure 15A:
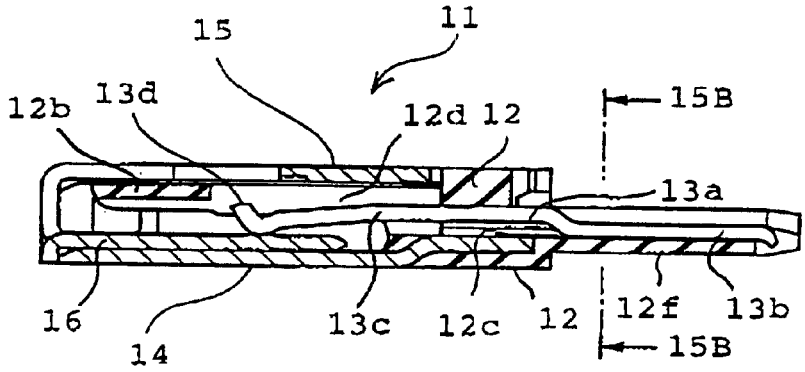
FIG. 15A is a sectional view of an FPC connector according to a fourth embodiment of the present invention along line 15A—15A in FIG. 14C
Figure 15B:
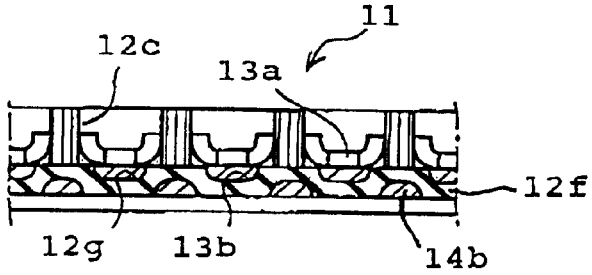
FIG. 15B is a sectional view along line 15B—15B in FIG. 15A.

The upper diagram in FIG. 14A, shows a perspective view of a state where the first shell is molded into the insulator, whilst the lower diagram in FIG. 14A shows a perspective view of the first shell (ground plate). FIG. 14B is a perspective view showing a state prior to insertion of a second shell and slider into an insulator and first shell which have been formed integrally by molding. FIG. 14C shows a state where assembly of an FPC connector 1 has been completed. FIG. 15A shows a sectional view along line 15A—15A in FIG. 14C, and FIG. 15B shows a sectional view along line 15B—15B in FIG. 15A.

The FPC connector 11 comprises an insulator 12, a plurality of contacts 13 inserted by pressure in an aligned fashion in the insulator 12, a first shell 14 formed integrally by molding with the lower section of the insulator 12, a second shell 15 which engages by sliding on the upper face of the insulator 12, and a metal slider 16.

The insulator 12 is formed in a frame shape in the rear part (lower left part in FIG. 14A), and comprising a plate-shaped projecting section in the front part (upper right part in FIG. 14A).

In other words, the insulator 12 comprises a long and thin prismatic section 12*a* and a flange section 12*b* projecting rearwards from the vicinity of the upper edge region of the prismatic section 12*a*, a plurality of contact retaining holes 12*c* juxtaposed in the longitudinal direction of the prismatic section 12*a* being formed therein, first contact receiving grooves 12*d* being formed in the lower face of the flange section 12*b*, and slit-shaped holes 12*e* being opened in the base section of the contact receiving grooves 12*d*. Furthermore, a plate-shaped section 12*f* projects in a forward direction (right upward direction in FIG. 9) from the prismatic section 12*a*, and a plurality of second contact receiving grooves 12*g* respectively connected to said plurality of contact retaining holes 12*c* are formed in the upper face of this plate-shaped section 12*f*.

Each of the contacts 13 comprises a contact retaining section 13*a* which is press-fitted into a contact retaining holes 12*c*, a contact section 13*b* extending forwards from same and fitted into the second contact receiving grooves 12*g*, a cantilever shaft section 13*c* extending in the opposite, rearward direction, and fitted into the first contact receiving grooves 12*d* with a play, and a U-shaped section 13*d* formed at the end portion thereof. This U-shaped section 13*d* constitutes the FPC contact section.

The first shell 14 comprises an approximately rectangular plate section 14*a*, a plurality of shell terminal sections 14*b* formed on the front edge of the plate section 14*a*, a pair of ground sections 14*c* formed projecting on either side of the shell terminal sections 14*b*, and a pair of lock sections 14*d* formed projecting on either side of the plate section 14*a*. The first shell 14 is attached by molding to the lower face of the insulator 12. In this case, the plate section 14*a* serves as a side wall opposing the flange section 12*b*. The shell terminal sections 14*b* are embedded in the lower face of the plate-shaped section 12*f* of the insulator 12, in such a manner that the surfaces thereof are exposed. The contacts sections 13*b* of the contacts and the shell terminal sections 14*b* are disposed in an alternating fashion in the plate-shaped section 12*f*. In other words, they are disposed in a zigzag fashion as illustrated in FIG. 15B.

In this FPC connector 11, the section for coupling with a receptacle connector is constituted by the plate member 12*f* of the insulator 12, the plug-side contact sections 13*b* press-fitted, with the surfaces thereof exposed, into the second contact receiving grooves 12*g* formed in one surface of said plate member 12*f*, in such a manner that they connect with the contact sections of the receptacle-side contacts, and the shell terminal sections 14*b* embedded by molding in the lower face thereof.

The second shell 15 is constituted by an approximately rectangular plate section 15*a* and a pair of engaging sections

15*b* formed by bending at respective ends of the plate section 15*a*, which couple with the insulator 12 and also engage with the lock sections 14*d* in the first shell 14.

The metal slider 16 is constituted by a plate section 16a and inserting sections 16b formed at either end of the plate section 16a, which are inserted into a portion of the respective pair of engaging sections 15*b* of the second shell. The slider 16 is retained slidably in the forward/rearward direction with respect to the second shell 15.

The second shell 15 and the metal slider 16 may also be formed in an integral fashion. In this case, the inserting sections 16*b* become obsolete, and the slider 16 is retained slidably by means of the engaging sections 15*b* and the lock sections 14*d*.

In the state in FIG. 14B, when the second shell 15 and slider 16 are slid and coupled with the first shell 14 molded to the insulator 12, the respective engaging sections 15*b* of the second shell 15 are coupled and fixed to the lock sections 14*d* of the first shell 14, thereby completing assembly of the FPC connector 11 as illustrated in FIG. 14C.

One side wall of the FPC inserting section for connecting to the aforementioned FPC is formed by the plate section 14*a* of the first shell 14 made from metal, whilst the other side wall thereof is formed integrally with the flange section 12*b* of the insulator 12, and the U-shaped sections 13*d* of the contacts 13 for connecting with the FPC are exposed between these respective side walls.

The slider 16 is disposed in such a manner that it can slide over the plate section 14*a* of the first shell 14. As stated previously, if the slider 16 is pulled out in a rearward direction, an FPC is introduced between the contacts 13 and the plate section 14*a* in the FPC inserting section, and the slider 16 is then pushed back into position, the FPC will be pressed against the U-shaped sections 13*d* of the contacts 13 thereby connecting the FPC, electrically and mechanically, to the FPC connector 11.

Figure 16:
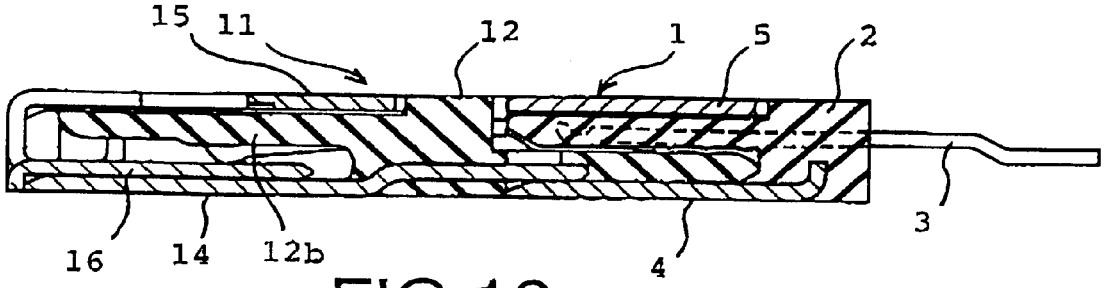
FIG. 16 is a sectional view showing an FPC connector according to a fourth embodiment of the present invention and a receptacle connector of a thin type according to the first to third embodiments of the present invention, in an coupled state.

FIG. 16 illustrates a state where this FPC connector 11 is connected to a first to third receptacle connector 1.

As revealed by the foregoing description, according to the present invention, it is possible to provide a connector of a thin type which prevents EMI, has a simple structure, and moreover, has low costs.

What is claimed is:

1. A receptacle connector of a thin type characterized in that said receptacle connector comprises an insulator formed in a frame shape, and a plurality of contacts fixed to said insulator, and that of a pair of opposing side walls of the connector constituting a section for coupling with a plug connector, one side wall is formed by a first shell made from metal, and the other side wall is formed integrally by said insulator;

each of said plurality of contacts comprising a section for attaching to the insulator, a cantilever shaft section extending forward from said attaching section, a contact section at the front end thereof, and a terminal section extending rearward from said cantilever shaft section;

a plurality of contact receiving grooves being formed in parallel fashion in the inner face of said side wall of said insulator, whereby the respective cantilever shaft sections of said contacts fit loosely into respective contact receiving grooves, said contact sections projecting toward said first shell from said contact receiving grooves; and the side wall of said insulator forming the base portion of said contact receiving grooves and comprising through holes of smaller dimension than the contact sections of said contacts, provided in the portion thereof opposing the contact sections of said contacts.

2. A receptacle connector of a thin type characterized in that said receptacle connector comprises an insulator formed in a frame shape, and a plurality of contacts fixed to said insulator, and that of a pair of opposing side walls of the connector constituting a section for coupling with a plug connector, one side wall is formed by a first shell made from metal, and the other side wall is formed integrally by said insulator;

each of said plurality of contacts comprising a section for attaching to the insulator, a cantilever shaft section extending forward from said attaching section, a contact section at the front end thereof, and a terminal section extending rearward from said cantilever shaft section;

a plurality of contact receiving grooves being formed in parallel fashion in the inner face of said side wall of said insulator, whereby the respective cantilever shaft sections of said contacts fit loosely into respective contact receiving grooves, said contact sections projecting toward said first shell from said contact receiving grooves;

the side wall of said insulator forming the base portion of said contact receiving grooves; and slits of a width smaller than the width of the contact sections of said contacts being formed at least in the portion thereof opposing the contact sections of said contacts.

3. The receptacle connector of a thin type according to one of the claim 1 or 2 further characterized in that a plurality of bend sections formed on one side edge of said first shell are molded in said insulator.

4. The receptacle connector of a thin type according to one of the claim 1 or 2 further characterized in that a second shell made from metal is layered over the outer surface of said other side wall, and a connection is made between connecting sections of said first shell and connecting sections of said second shell.

5. The receptacle connector of a thin type according to claim 3, characterized in that said plurality of contacts and said plurality of bend sections in said first shell are disposed in a zigzag fashion in said insulator.

6. The receptacle connector of a thin type according to one of the claim 1 or 2 further characterized in that insulating tape or an insulating coating is provided on the surface of said first shell opposing said contacts.

7. A receptacle connector of a thin type characterized in that said receptacle connector comprises an insulator formed in a frame shape, and a plurality of contacts fixed to said insulator, and a pair of opposing side walls of the connector constituting a section for coupling with a plug connector, one side wall being formed by a first shell made from metal, and the other side wall being formed integrally by said insulator;

a plurality of bend sections formed on one side edge of said first shall being molded in said insulator;

a second shell made from metal being layered over the outer surface of said other side wall, and a connection between connecting sections of said first shell and connection sections of said second shell;

each of said plurality of contacts comprising a section for attaching to the insulator, a cantilever shaft section extending forward from said attaching section, a contact section at the front end thereof, and a terminal section extending rearward from said cantilever shaft section;

a plurality of contact receiving grooves being formed in parallel fashion in the inner face of said side wall of said insulator, whereby the respective cantilever shaft sections of said contacts fit loosely into respective contact receiving grooves, said contact sections projecting toward said first shell from said contact receiving grooves;

said plug connector also being of a thin type and having a plug-side coupling section which is introduced into the coupling section of the receptacle connector;

said plug-side coupling section comprising a plug-side insulator plate member, and plug-side contacts having plug-side contact sections embedded in one surface of said plate member with the surface thereof being exposed in such a manner that they form a contact with the contact sections of said receptacle-side contacts;

said plug connector being a connector for connecting an FPC (flexible printed circuit), comprising a plug-side insulator, a rearward portion of which is formed in a frame shape and a front portion which incorporates a plate-shaped section, the plurality of said plug-side contacts being fixed to said plug-side insulator, and the pair of opposing side walls forming an FPC insertion section for connecting to said FPC, one of said side walls being formed by a first plug-side shell made from metal, and the other of said side walls being formed by a first plug-side shell made from metal, and the other of said side walls being integrally formed by said plug-side insulator, contact sections of said plug-side contacts for connecting with the FPC being exposed inside said FPC inserting section;

said first plug-side shell comprising a plurality of shell terminal sections formed on a front edge thereof, said shell terminal sections being embedded in the rear face of said plate-shaped section of said plug-side insulator and being disposed in a zigzag fashion with the plug-side contact sections of said plug-side contacts in said plate-shaped section, the contact sections of the contacts and the shell terminal sections being disposed in a zigzag fashion on both the front and rear surfaces of the plate-shaped section.

8. The plug connector of a thin type according to claim 7 further characterized in that a second plug-side shell made from metal is layered over the outer surface of the side wall constituted by said plug-side insulator of said FPC inserting section, and a slider is engaged with and retained by said first plug-side shell in such a manner that it may slide in and out of said FPC inserting section, over said first plug-side shell.

* * * * *

UNITED STATES PATENT AND TRADEMARK OFFICE

CERTIFICATE OF CORRECTION

PATENT NO. : 6,565,389 B1
DATED : May 20, 2003
INVENTOR(S) : Isao Igarashi

It is certified that error appears in the above-identified patent and that said Letters Patent is hereby corrected as shown below:

Title page,
Item [57], ABSTRACT,
Line 3, before "coupling section" insert -- receptacle connector --

Column 1,
Line 27, change "plug-side" to -- receptacle --

Column 4,
Lines 7 and 65, change "an" to -- a --

Column 6,
Line 4, change "illustrated" to -- illustrates --

Figure 13B:
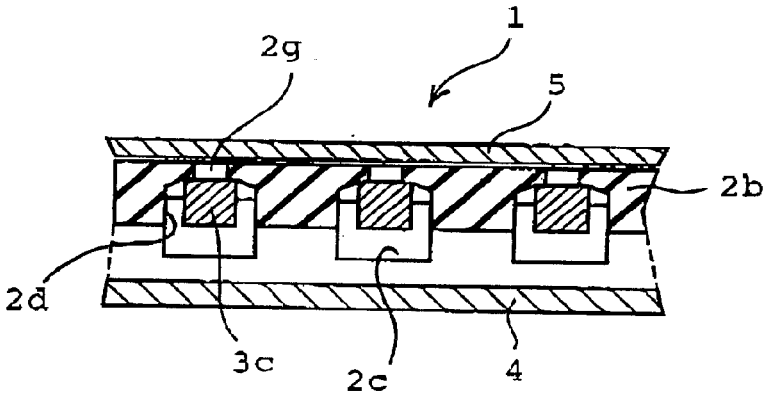
FIG. 13B is a sectional view of same along line 13B—13B in FIG. 13A.

Column 7,
Line 29, change "FIG. 7 and FIG. 8" to -- FIGS. 12A through 13B --
Line 30, change "FIG. 7" to -- FIGS. 12A through 13B --
Line 37, change "FIG. 8" to -- FIG. 13B --
Line 43, delete "the" (first occurrence)
Line 60, change "FIG. 9" to -- FIG. 14A --

Column 8,
Line 26, change "FIG. 9" to -- FIG. 14A --
Line 32, delete "a"

Column 9,
Line 2, change "couple" to -- coupled --

Column 10,
Line 31, change "claim" to -- claims --
Line 35, change "claim" to -- claims --
Line 45, change "claim" to -- claims --
Line 57, change "shall" to -- shell --

UNITED STATES PATENT AND TRADEMARK OFFICE

CERTIFICATE OF CORRECTION

PATENT NO. : 6,565,389 B1
DATED : May 20, 2003
INVENTOR(S) : Isao Igarashi

It is certified that error appears in the above-identified patent and that said Letters Patent is hereby corrected as shown below:

Column 12,
Lines 1-2, delete repetitive line "said side walls being formed by a first plug-side shell made from metal, and the other of"

Signed and Sealed this

Twentieth Day of January, 2004

JON W. DUDAS
*Acting Director of the United States Patent and Trademark Office*